US005784733A

United States Patent [19]

Rasamny et al.

[11] Patent Number: 5,784,733

[45] Date of Patent: Jul. 28, 1998

[54] BLANKET WITH COMPARTMENT HOUSING A SOUND PRODUCING DEVICE

[76] Inventors: Khalil Rasamny; James Barone, both of 165 Grassy Plains St., Bethel, Conn. 06801

[21] Appl. No.: 855,861

[22] Filed: May 12, 1997

[51] Int. Cl.[6] ..... A47G 9/02

[52] U.S. Cl. ..... 5/482; 5/904; 446/81; 84/600

[58] Field of Search ..... 5/485, 904, 482; 446/81, 28; 2/83, 75, 80, 94, 69, 69.5; 84/600, 95.1, 95.2, 94.1

[56] References Cited

U.S. PATENT DOCUMENTS

| | | | |
|---|---|---|---|
| 2,994,889 | 8/1961 | Oblander | 446/81 |
| 4,525,878 | 7/1985 | Lowe, Jr. | 2/185 R |
| 4,875,238 | 10/1989 | Solomon et al. | 446/28 |
| 5,443,880 | 8/1995 | Wike | 5/485 |

FOREIGN PATENT DOCUMENTS

| | | | |
|---|---|---|---|
| 2601237 | 1/1988 | France | 5/904 |

*Primary Examiner*—Alexander Grosz

*Attorney, Agent, or Firm*—Edward R. Hyde

[57] ABSTRACT

A blanket or child's garment is equipped with a manually operable musical device that is enclosed in a waterproof envelope that in turn is enclosed in a cloth compartment attached to the blanket or child's garment.

1 Claim, 1 Drawing Sheet

BLANKET WITH COMPARTMENT HOUSING A SOUND PRODUCING DEVICE

BACKGROUND OF THE INVENTION

1. Field of the Invention

The present invention relates to a blanket or cover that would be used for a child or a child's doll. More specifically the invention concerns childsware such as a blanket that is equipped with a small musical sounding device that would fascinate and entertain a child. As used herein childsware includes childs clothing or blankets.

As is well known, very young children that sleep in cribs and baby carriages are often provided with devices such as rattles for amusement purposes. These devices are conventionally available for the child to move and play with because child amusement is enhanced when the child himself can have an influence on the device that amuses him. The present invention contemplates a small musical device embedded in child's blanket which can be actuated by the child and which will attract his attention and cause him to be amused.

2. Description of the Prior Art

As noted above, amusement devices including sound producing units provided for small children in beds and cribs are known to the prior art. As examples, U.S. Pat. No. 5,309,586 provides a sound device installed in a flexible cover and depends upon mechanical movement of the cover or blanket in order to produce the sounds. U.S. Pat. No. 2,994,889 contemplates a sound producing pad or mattress in which the sound results from the movement of the child.

French Patent No. 2,601,237 comtemplates a musical device embedded in a child's blanket for the purpose of providing a musical sound for the child.

Although the above patents disclose contemplate the idea of a sound or musical bedding material, they fail to disclose a convenient and efficient structure securing an amusing musical device within a child's blanket.

Accordingly, it is a primary objective of the present invention to provide a childsware having a sound producing device that is securely and conveniently mounted on or within the blanket.

Another object of the present invention is to provide a childsware with a sound producing unit that is secured within the garment in a manner providing easy access to the child so that it can be readily actuated.

BRIEF DESCRIPTION OF THE DRAWINGS

The foregoing and still other objects and advantages of the present invention will be more apparent from the following detailed explanation of the preferred embodiments of the invention considered in connection with the accompanying drawings herein in which.

DESCRIPTION OF A PREFERRED EMBODIMENT

Figure 1:
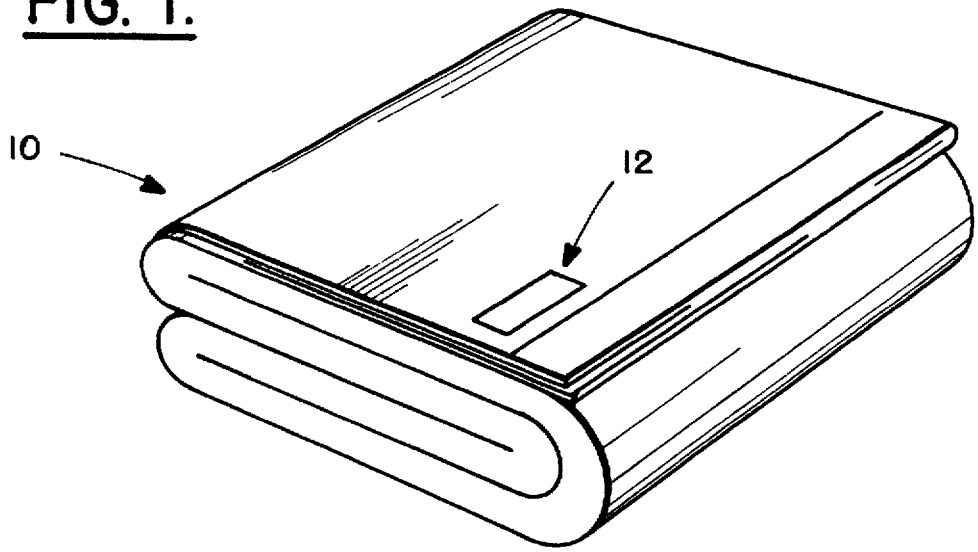
FIG. 1 is a perspective view of a blanket having a sound device.

Referring to the drawings, numeral 10 designates a blanket or cover made of cloth and of any construction or weave. It is a blanket that would be used, for example, in a child's crib. Alternatively, it might be a doll's blanket. Along one edge of the blanket and in the area of an end, thereof, there is a sound producing system 12.

Figure 2:
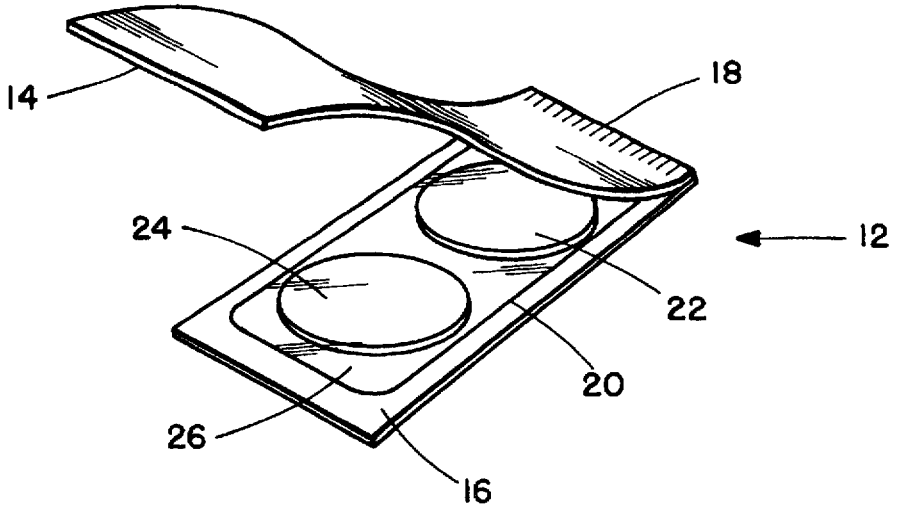
FIG. 2 is a perspective view of the sound device located within it's compartment which is shown partially open.
Figure 3:
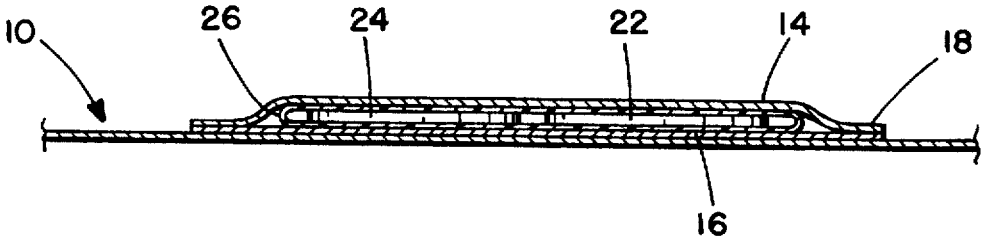
FIG. 3 is a side view in section of the sound device located within its compartment secured to a blanket.

The system is shown in more detail in FIG. 2 as comprising two strips of cloth 14, 16 sewed together around their edges as at 18. A sound producing device 20 is located within the pocket or compartment formed by strips 14 and 16. The sound producing device may be of any convenient construction and are readily commercially available. The device includes a battery and the appropriate circuitry to provide a sound such as the notes of a tune. As shown in FIG. 2, the device 20 comprises two disks 22 and 24. One of the disks serves as a pressure switch and by simple finger pressure on both sides the device is actuated and a tune is played. A timing device within the unit 20 turns the sounding device off when the tune is completed. Thereafter, pressure on the disk will reinitiate the tune.

The sound unit 20 is sealed within a waterproof envelope 26 which may be made of a plastic material. Although the envelope is waterproof, the sound from unit 20 readily passes through the envelope to be heard.

Another important feature of the invention is that the sounding device is located within its own compartment which in turn is sewn to the blanket. Alternatively, the compartment may be secured to the blanket by other means such as velcro cloth fasteners or snappers.

When it is desirable to change the sounding device 20 because the battery is discharged or it is desirable to change the tune by substituting a different sounding device, it is only necessary to undo the threads 18 along one side of the compartment and substitute a new unit 20.

Having thus described the invention with particular reference to the preferred forms thereof, it will be obvious that various changes and modifications may be made therein without departing from the spirit and scope of the invention as defined in the appended claims.

Although the specific embodiment herein described discloses the invention in connection with a blanket, it is understood that it is equally applicable to other childsware such as a jacket, booty or other such item.

What is claimed is:

1. A blanket apparatus comprising:

a cloth blanket of pliable flexible material;

a generally rectangular shaped cloth compartment formed of two pieces of cloth sewn along the periphery thereof;

a flat sound producing device located within said cloth compartment said sound producing device including a manually operable switch and a timing device to control the period of time of the sound;

a water impermeable envelope located within said cloth compartment and surrounding said sound producing device;

said cloth compartment being securely sewn to the cloth blanket in the area of a corner thereof.

* * * * *